US005339969A

United States Patent [19]

Filipowski

[11] Patent Number: 5,339,969

[45] Date of Patent: Aug. 23, 1994

[54] QUICK ASSEMBLY HANGING FILE FOLDER FRAME

[76] Inventor: George H. Filipowski, 445 E. 65th St., New York, N.Y. 10021

[21] Appl. No.: 62,063

[22] Filed: May 6, 1993

[51] Int. Cl.[5] ..... A47F 5/00

[52] U.S. Cl. ..... 211/189; 211/46; 312/184

[58] Field of Search ..... 211/189, 46, 195; 312/184

[56] References Cited

U.S. PATENT DOCUMENTS

| | | | |
|---|---|---|---|
| 3,295,697 | 1/1967 | Patterson | 312/184 X |
| 3,651,949 | 3/1972 | Carter et al. | 211/189 |
| 3,651,950 | 3/1972 | Carter | 211/189 |
| 3,734,300 | 5/1973 | Carter | 211/189 |
| 3,853,227 | 12/1974 | Filipowski . | |
| 3,999,663 | 12/1976 | Walter et al. | 211/189 X |

OTHER PUBLICATIONS

Pendaflex advertisement.
SteelWorks advertisement.
Attitype/Anthes advertisement.

*Primary Examiner*—David A. Scherbel
*Assistant Examiner*—Robert W. Gibson, Jr.
*Attorney, Agent, or Firm*—Lilling & Lilling

[57] ABSTRACT

The frame for hanging files may be quickly assembled and does not require tools or any type fastening devices. The rails for holding the files are positioned within the channel of a rail housing, that is positioned at the top end of rail supports. A locking bar with a cam head pivots within the rail housing to first bear against the rail and then to hold the rail in position within the channel of the rail housing. Support bars are then used to hold the locking bar in position and to provide stability for the frame.

9 Claims, 4 Drawing Sheets

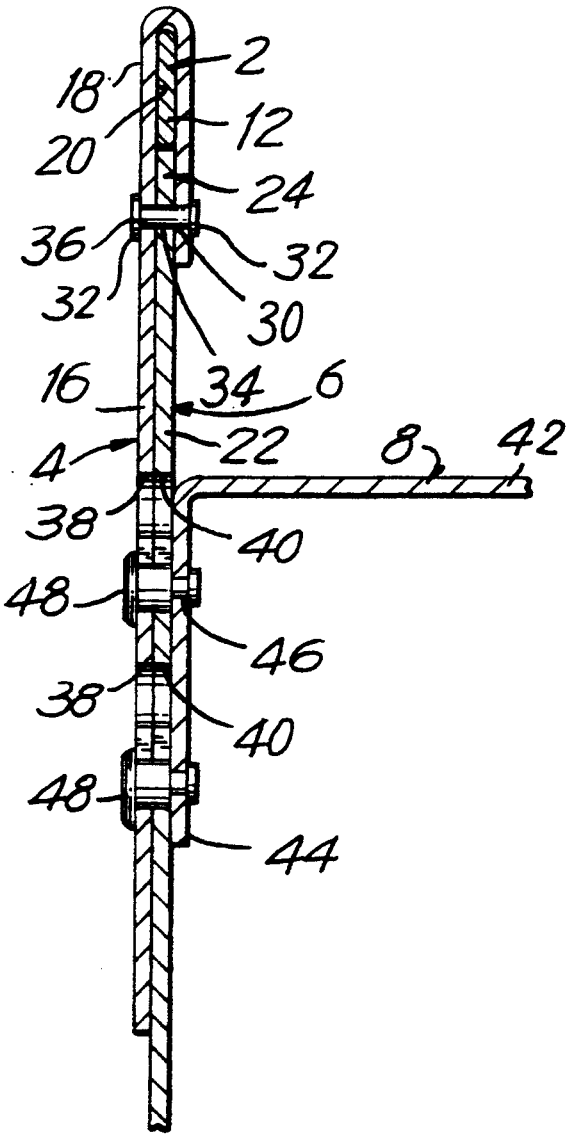
FIG. 6
FIG. 7
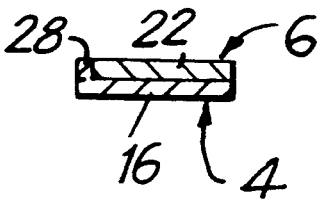

QUICK ASSEMBLY HANGING FILE FOLDER FRAME

FIELD OF THE INVENTION

The invention relates to the field of frames for hanging file folders. In particular, it involves a frame for hanging files that can be quickly assembled and without the need for screws, bolts and tools.

BACKGROUND OF THE INVENTION

In modern offices, one of the more popular types of files are the so-called hanging files. These files are of common shape and configuration, except that they have little metal clips on each side, or notched metal or plastic rods, so that the files can be hung or suspended from parallel rails. These parallel rails are arranged in a support frame that may be typically disposed in the file drawer of a desk or cabinet.

There are several problems with the state of the art support frames for hanging files. Many of these frames suffer from stability problems. As a result, the frames wobble from side to side and can be prone to collapse. Another problem is that they typically require screws or bolts or other fasteners and tools and can be quite complicated and time-consuming to assemble.

A frame for hanging files was invented by me and described in my prior U.S. Patent in 1974 (U.S. Pat. No. 3,853,227), but that structure suffers from stability problems. This device includes parallel rails, ones which are inserted into respective grip clips. Locking rods are then rotated into position, so as to grip the grip clips. A cross support bar is then used to provide some stability to the unit. A problem with this device is that it is not sufficiently stable and is prone to rock back and forth. Further, the rails are not held sufficiently securely and the rails can become disengaged and the frame can collapse.

Pendaflex has a simple frame that snaps together, but this assembly is not stable and it can become easily disassembled, and collapse. SteelWorks, Inc. has another type of frame, where the rods and supports fit together. The problem with this frame is that it is not stable and there can be cambering of the rail, which can cause the folders to fall off the rails. Another frame is made by Attitype/Anthes and it provides a frame that snaps together. This frame is not sufficiently strong or stable and is prone to collapse it can also rock back and forth and does not securely hold the file folders.

SUMMARY OF THE INVENTION

Therefore, there is a need in the industry for a frame for hanging files that can be quickly and efficiently assembled, and which is strong and stable, and which will not collapse. Such a frame is provided by the invention of this application.

The frame of this application is designed to support parallel rails in a uniform and stable position. Each end of the rail is fit into a channel in a U-shaped housing. A locking bar is then rotated, and its cam-shaped end engages the rail and locks it in place. The support bar is then used to connect the adjacent locking bars. This arrangement provides a strong and sturdy frame for hanging files, which can be easily and simply constructed.

BRIEF DESCRIPTION OF THE DRAWINGS

FIG. 6 is a cross sectional view taken along the line 6—6 of FIG. 2.

FIG. 7 is a cross-sectional view taken along the lines 7—7 of FIG. 2.

DETAILED DESCRIPTION OF THE INVENTION

Figure 1:
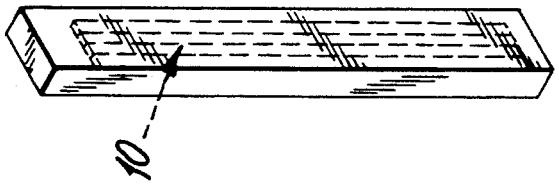
FIG. 1 is a perspective view of a package containing the disassembled quick assembly frame of this invention.
Figure 2:
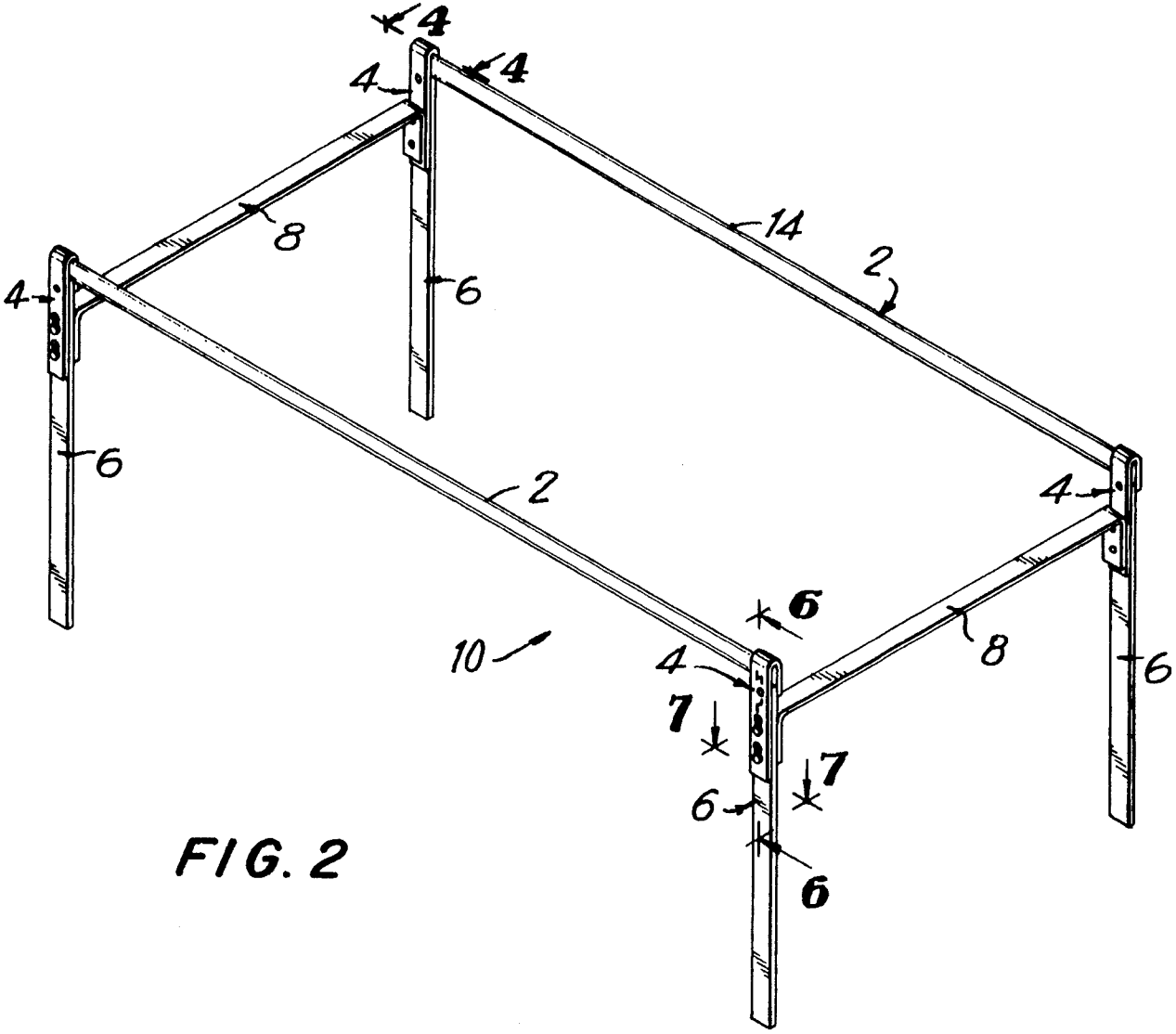
FIG. 2 is a perspective view of the quick assembly frame of this invention fully assembled.

The quick assembly frame 10 includes four basic elements. These parts would include parallel rails 2, rail supports 4 at each end of the rails, a locking bar 6 to lock a rail in a respective rail support, and support bars 8 to connect adjacent rail supports and locking bars.

The elements constituting the quick assembly frame may be made of any desirable material. In the preferred embodiments, the parts would be made of metal, but they would also conceivably be made of plastic or even wood, or any other sufficiently rigid material that would have enough strength to hold a plurality of hanging files.

Each of the rails 2 would be an elongate bar or plate of an essentially rectangular or square profile. It should be designed so that the top edge 14 of the rail can support hanging files of a conventional type. In the preferred embodiment, the rail would be essentially of a rectangular configuration and cross section, because it provides better support for the hanging files and will more easily lock into position, In some embodiments, however, it may be desirable to use a rail of a round profile configuration, or some other desired shape. This too would come within the scope of the invention.

While the preferred embodiment of the invention contemplates solid rails of a specified length, it is possible to use the invention in connection with variable length rails. By this is meant rails that telescope one within the other, so as to be movable to different lengths.

The rail support 4 consists of an essentially flat elongate surface 16. The top portion of the rail support 4 is bent over itself to define a U-shaped rail housing 18 with a central channel 20. It is preferred that the surface 16 of the rail support 4 be flat, as this will provide the best interaction of the parts. During assembly of the frame 10, the end 12 of the rail 2 would be fitted within the channel 20 of the housing 18 of the rail support 4.

In the preferred embodiment, the locking bar 6 would include a substantially flat planar surface 22. The top portion of the locking bar 6 would have a curved end 24 to define a cam-surface.

Figure 3:
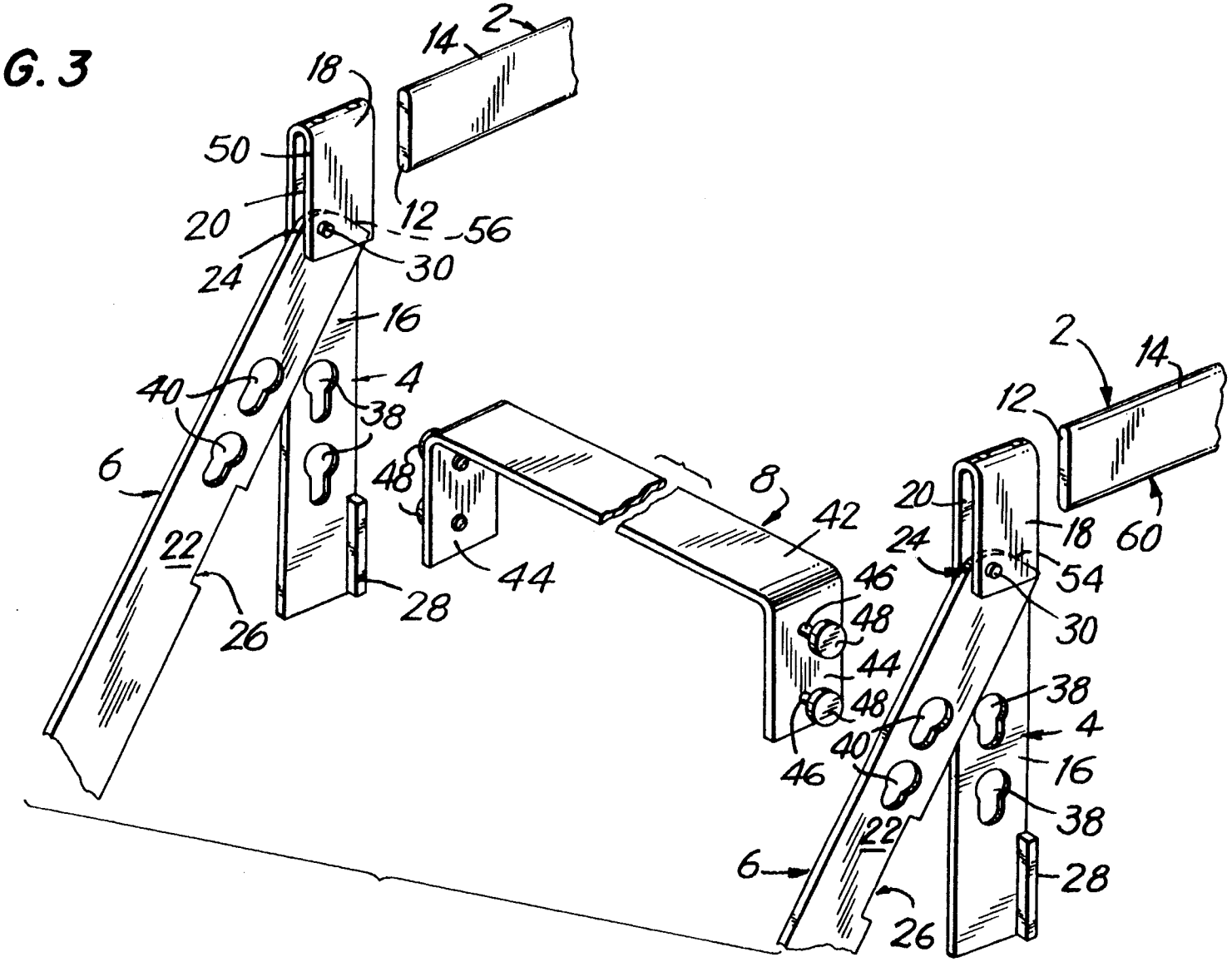
FIG. 3 is an enlarged, exploded perspective view of one of the ends of the quick assembly frame and showing the manner in which the pieces fit together.
Figure 4:
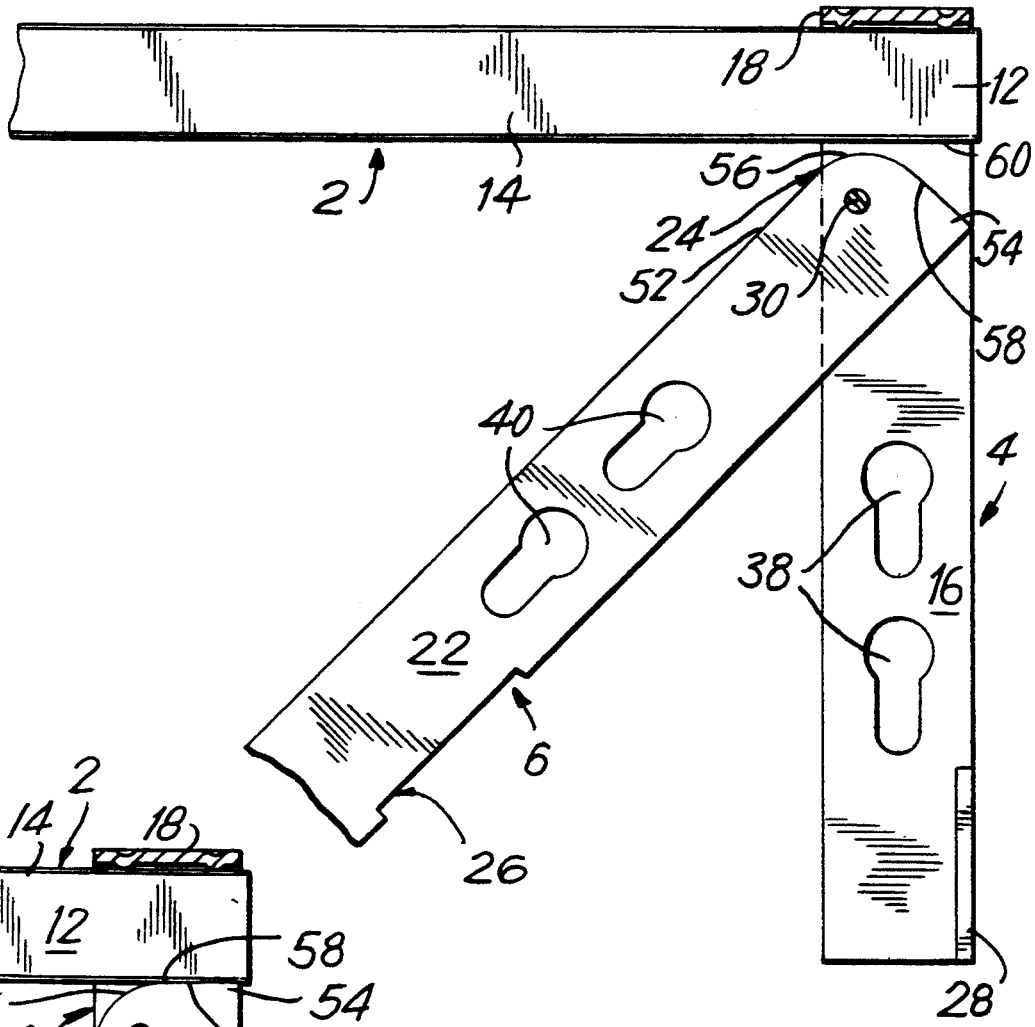
FIG. 4 is a side view of the rail, locking bar, and the rail support in an unlocked position.
Figure 5:
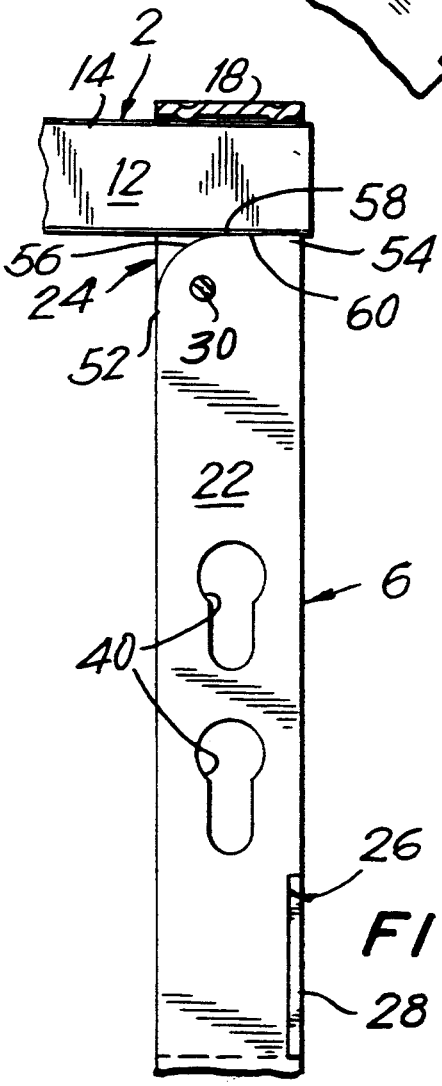
FIG. 5 is a side view similar to FIG. 4, except that it shows the locking bar locking the rail in position in the rail support.

At the end of the locking bar 6 at which the cam-surface 24 is defined, a through hole 34 is made in the locking bar 6. The end of the locking bar 6 with the cam-surface 24 would be placed against the rail support 4, so that a portion of the cam-head 24 is positioned within the channel 20 defined within the rail housing 18. Appropriate through holes 36 are made on both sides of the housing 18 and a pin 30 is used to secure the locking bar 6 to the housing 18. Preferably the pin 30 will have enlarged heads 32 which bear against the outer surfaces of the housing 18 and which will serve to prevent the pin from becoming dislodged. This arrangement should be configured, so as to permit the locking bar 6 to pivot about the pin from an open position (as shown in FIGS. 3 and 4) to a locking position (as shown in FIGS. 5 & 6).

The surface 22 of the locking bar 6 may also have a cut out 26 which interacts with a stop 28 positioned on the surface 16 of the rail support 4. This is designed to limit the motion and movement of the locking bar 6 and to ensure that it stays in the correct position.

It is preferred that both the surface 16 of the rail support 4 and the surface 22 of the locking bar 6 have key openings 38 and 40. As shown in the drawings, these key openings should be in alignment.

The support bar 8 can have many different configurations. It can be a solid bar (not shown) that extends between the opposing rail supports 4. In the preferred embodiment, the support bar 8 is a U-shaped bracket with a top surface 42 and downward extending end surfaces 44. Rivets with a narrow stem 46 and an enlarged head 48 are secured to each of the ends 44 of the support bar 8. In the preferred embodiment, there are two such rivets on each of the ends 44 of the support bar 8. In assembling the frame, after the locking bar 6 is placed in the locking position to hold the rail 2 securely, the key openings 38 and 40 are in alignment and the enlarged heads 48 of the rivets on the support bar 8 are placed within the key openings to hold the assembly firmly in position.

In the preferred embodiment, the rail support 4 may have an overall length, from top to bottom, of about 3.5 inches. The height of the rail housing 18 would be about 1 inch. The diameter of the openings 36 in the rail housing 18 for the pin 30 would be 0.13 inches and the center point of the opening 36 should be 0.25 inches from the bottom of the rail housing and 0.187 inches from the outer edge 50 of the rail housing.

The width of the surface 16 of the rail support 4 may typically be about 0.625 inches and the width of the channel 20 within the housing 18 may be about 0.13 inches. The thickness of the surface 16 of the rail support 4 may be about 0.598 inches or about 16 gauge.

The overall length of the locking bar 6 may typically be about 8.875 inches. It too may have a width of 0.625 inches. The thickness of the surface 22 of the locking bar 6 may typically be about 0.125 inches. As the locking bar 6 is essentially the main vertical support for the assembly, it must be of a sufficient thickness to securely support the fully loaded frame. Further, the overall length of the locking bar 6 must be sufficient, so as to provide some separation between the bottom edge of the file and the surface on which the frame is supported.

In the preferred embodiment, the hole 34 for the pin 30 may have a diameter of 0.13 inches. The center point of this opening should preferably be 0.187 inches from both the outer edge 52 and the top edge 54 of the surface 22 of the locking bar 6.

The length of the support bar 8 will be dependent on whether the frame is to be used for letter or legal size folders. If the frame is to be used in connection with folders for letter size papers, then the overall length of the top 42 of the support bar 8 from one end 44 to the other end 44 would be about 12 inches. In the case of use of this frame for folders for legal size papers, then a more appropriate length may be 15 inches. (These lengths are measured from the outer surfaces of one end 44 to the outer surface of the other outer end 44). If desired, the top 42 of the support bar 8 may be made to accommodate variable lengths and to telescope between different positions, so as to accommodate folders of different sizes. It may also be appreciated that the frame may be used for folders of sizes other than for letter or legal size, and a support bar of a different length may thus be used.

Typically, the thickness of the top 42 and ends 44 of the support part 8 would be about 0.125 inches and the width of these surfaces would be 0.625 inches. This should provide the requisite strength for holding the assembly together.

As may be appreciated, the disassembled frame can be rather compactly packaged. All the pieces would be disassembled, except that the rail support 4 and the locking bar 6 remain connected. The rails 2 and the support bars 8 are separated and the pieces are nested together. The pieces can be bundled together in a package (as shown in FIG. 1) of approximately 30 inches in length, 2 inches in width and 1 inch in height. This is in contrast with the currently used frames, which may typically require a package of about 30 inches in length, 12 inches in width and 1 inch in height. The differences of 10 inches in the width of the package greatly facilitates shipping and storage of the disassembled frames.

Whereas the currently used frames may typically take upwards of 15 minutes to assemble and require nuts, bolts and tools, the frame of this invention may be assembled in as little as one or two minutes. Further, it does not require any tools or special equipment for construction.

To assemble the frame, the locking bar 6 is rotated to an open position (as shown in FIGS. 3 and 4).

The end 12 of the rail 2 would be fitted into the channel 20 of the rail housing 18 at the top end of the rail support 4. In the preferred embodiment, this should provide a snug fit, but should still provide for relatively easy movement of the rail in and out of the rail housing. The end 12 of the rail 2 should preferably not extend beyond the outer edge 50 of the rail housing 18.

The next step is to lock the rail 2 in position. This is accomplished by pivoting or rotating the locking bar 6 about the pin 30. First the rounded portion 56 of the top edge 54 of the locking bar 6 comes into contact with the bottom edge 60, and this rounded surface 56 rolls over the bottom surface 60 of the rail in a cam like movement. As the locking bar 6 continues to move, the flat portion 58 of the top edge 54 comes into contact with the bottom surface 60 of the rail 2 to lock the rail in position. (See FIGS. 5 and 6). The rail cannot be released unless the locking bar 6 is again rotated, so that the cam head 24 moves out of engagement with the lower edge 60 of the rail 2. To insure that the locking bar 6 does not move too far and maintains its position, the cutout 26 on the surface 22 of the locking bar 6 interacts and is held by the stop 28 on the surface 16 of the rail support 4.

The assembler would then select a support bar of the required length, depending on what size files are to be used. The enlarged heads 48 on the rivets on the ends 44 of the support bar 8 are fitted into the top portion of the key openings 38 and 40 in the rail support 4 and the locking bar 6, and then the support bar 8 is pushed downward. This accomplishes two results. The first is that the locking bar is now held securely in position and cannot be moved and this prevents the rail from being released from the rail housing. In addition, this causes the support bar 8 to securely connect the adjacent rail support (and locking bars) at one end of the frame.

It may be appreciated that the support bar 8 may have a single rivet on each of its ends 44, but greater stability is provided with two points of contact as opposed to a single point of contact. In an alternate embodiment, instead of rivets with enlarged heads, the ends 44 may include tounges which may interact with elongate grooves (that substitute for the key openings). Such a structure will work, but it may not provide the same degree of stability.

It may also be appreciated that the cutout 26 and the stop 28 can be eliminated and the locking bar can be held in position by whatever means is used to connect the support bar to the rail support 4 and the locking bar 6. Such a system would operate quite well, but there may be slightly more difficulty in properly aligning the locking bar 6 to lock the rail in position.

As shown, both the surface 22 of the locking bar 6 and the surface 16 of the rail support 4 are flat and this permits the locking bar 6 to slide over the surface of the rail support as the locking bar is moved into position. This is why a flat profile is preferred for these two portions of the frame.

In some embodiments it may be desirable for the rail support 4 to be longer than the locking bar 6 and for the rail support to be the vertical support for the frame. Such a modification would work essentially identical to the version described above, wherein the locking bar 6 is long and provides the vertical support for the frame. In the situation where the rail support is longer and serves as the vertical support for the frame, it may be desirable for the rail support to be made of a thicker and stronger material so as to more easily support the frame.

The invention is described in detail with reference to particular embodiments, but it should be understood that various other modifications can be effected and still be within the spirit and scope of the invention.

I claim:

1. A quick assembly hanging file frame, comprising:

a plurality of elongate rails;

a plurality of rail supports, each rail support having a rail housing that accommodates an end of a respective rail;

a plurality of locking bars, each locking bar having a cam head that pivots within said rail housing of a respective rail support to hold a respective rail in position within said rail housing; and a plurality of support bars with means to removeably connect said support bar to respective rail supports and locking bars.

2. A quick assembly hanging file frame, according to claim 1, wherein key openings are provided on the surfaces of said rail supports and said locking bar, and wherein rivets on said support bar fit into said key openings to removeably secure said support bar to respective rail supports and locking bars.

3. A quick assembly hanging file frame according to claim 1, wherein the cam head on said locking bar includes a rounded top portion and a flat top portion.

4. A quick assembly hanging file frame, according to claim 2, wherein the cam head on said locking bar includes a rounded top portion and a flat top portion.

5. A quick assembly hanging file frame, according to claim 1, wherein said rail support and rail housing comprise an elongate flat surface with a U-shaped housing defining a channel within which said end of said rail is accommodated.

6. A quick assembly hanging file frame, according to claim 2, wherein said rail support and rail housing comprise an elongate flat surface with a U-shaped housing defining a channel within which said end of said rail is accommodated.

7. A quick assembly hanging file frame, according to claim 3, wherein said rail support and rail housing comprise an elongate flat surface with a U-shaped housing defining a channel within which said end of said rail is accommodated.

8. A quick assembly hanging file frame, according to claim 4, wherein said rail support and rail housing comprise an elongate flat surface with a U-shaped housing defining a channel within which said end of said rail is accommodated.

9. A quick assembly hanging file frame, according to claim 1, wherein said rail support includes a stop, and wherein a cut out on a surface of said locking bar interacts with said stop on said rail support to define and limit the movement of said locking bar.

* * * * *